United States Patent [19]

Macaluso et al.

[11] 4,349,132

[45] Sep. 14, 1982

[54] DEVELOPER DISPENSING APPARATUS

[75] Inventors: Paul J. Macaluso, Norwalk; James E. Genthe, Newtown, both of Conn.

[73] Assignee: Pitney Bowes, Inc., Stamford, Conn.

[21] Appl. No.: 276,308

[22] Filed: Jun. 17, 1981

Related U.S. Application Data

[63] Continuation of Ser. No. 101,332, Dec. 6, 1979, abandoned.

[51] Int. Cl.[3] ..... B67D 5/38

[52] U.S. Cl. ..... 222/156; 222/DIG. 1

[58] Field of Search ..... 222/156, 158, 154, 157, 222/368, DIG. 1; 221/82, 155

[56] References Cited

U.S. PATENT DOCUMENTS 3,414,161 12/1968 Doring ..... 221/155 X
3,606,965 9/1971 Cortelyou et al. ..... 222/368 X
3,954,331 5/1976 Smith ..... 222/DIG. 1
4,079,867 3/1978 Tannehill ..... 222/368

FOREIGN PATENT DOCUMENTS 464357 4/1950 Canada ..... 222/368

*Primary Examiner*—Stanley H. Tollberg
*Attorney, Agent, or Firm*—Peter Vrahotes; Albert Scribner; William Soltow, Jr.

[57] ABSTRACT

A development powder dispensing apparatus that is in the form of a carousel. The apparatus has a generally cylindrical configuration that is divided into a number of chambers such that the development powder toner within each chamber may be supplied individually to a magnetic brush unit. Because of the separation of the toner into chambers, no toner compression is experienced even though large amounts of toner may be stored.

4 Claims, 2 Drawing Figures

DEVELOPER DISPENSING APPARATUS

This is a continuation of application Ser. No. 101,332, filed Dec. 6, 1979, now abandoned.

BACKGROUND OF THE INVENTION

In the field of electrophotography development powders are used to develop an electrostatic image on a photoconductive surface. There are generally two types of dry development powder, single component and dual component. The dual component development comprises carrier particles such as iron filings or glass beads and toner particles which are attracted by electrostatic charge to the carrier particles. Because the carrier particles are of a large size and the toner particle attracted thereto are of a relatively small size, large quantities of dual component development powder may be stored in a dispensing unit without concern of the compression effect, i.e. the development powder at the bottom of the dispenser being crushed due to the pressure created by the large volume. This is not true in the use of a single component development powder or toner particles that are stored for replenishment purposes. A single component development powder is generally made of a homogeneous toner particle containing a magnetic substance such as magnetite. With regard to a dual component development powder, theoretically only the toner portion is consumed during development and this toner must be replenished. When a large quantity of single component development powder or toner material is stored, a "pressure head" is developed at the bottom of the storage hopper. Single component development powder and toner particles inherently lack compression strength so that storing a large amount of such materials in a dispensing unit is difficult due to the compression effect, and in many cases, these materials are designed, chemically, to permit pressure fixing and thus form agglomerates more readily. Additionally, the action of the fluctuating magnetic field used to transport the material to the development zone can act to detrimentally compact the toner in certain regions of the development sump. Thus, obviously, it would be desirable to be able to store large quantities of single component development powder or toner particles without having to be concerned about the particles being crushed due to the compression effect.

SUMMARY OF THE INVENTION

In order to store a large quantity of single component developer powder or toner within a developer unit without compacting the development powder, a dispensing apparatus for storing this quantity of developer powder is provided that has individual storage compartments. The advantage gained with such a structure is that a large amount of developer may be stored without the "pressure head" of development powder building up at the bottom of the storage hopper. As is well known, such a pressure head results in starvation of the magnetic brush applicator roller since the development powder may actually bridge over the roller. In the preferred embodiment the dispensing apparatus includes a generally cylindrical housing that has a rotatable spyder therein. The spyder has arms that cooperate with the walls of the housing to form the individual compartments.

DETAILED DESCRIPTION OF THE PREFERRED EMBODIMENT

Figure 1:
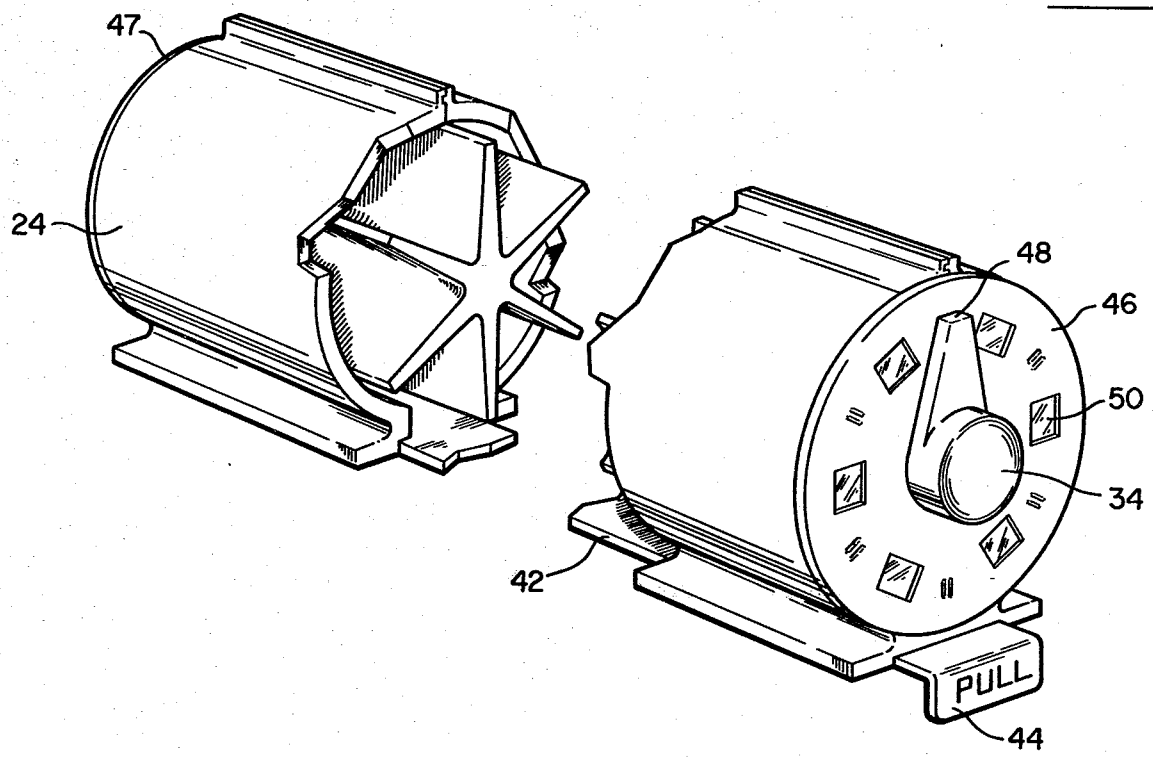
FIG. 1 is perspective view of a development powder dispensing apparatus made in accordance with the instant invention, portions being removed for clarity.

Referring now to the drawing, a development powder dispensing apparatus is shown generally at 10 mounted on a magnetic brush unit 12 that is adjacent to a photoconductive drum 14 having a surface composed of zinc oxide, selenium or the like. The photoconductive drum 14 will have a plurality of stations disposed about the perimeter thereof for forming and developing an image and transferring the image of an original onto a copy. None of these stations is shown with the exception of the development station as such stations do not form a part of the instant invention. As the surface of the photoconductive drum 14 comes into contact with a magnetic brush unit, the electrostatic image present thereon will be developed as is well known in the art. The magnetic brush unit includes a housing that forms a sump 16 with an upper opening 17 and a lower opening 19 and a magnetic applicator roller 18 that is supported within the opening 19 of the housing 16 by a shaft 20 for rotation as indicated by the arrow in FIG. 2. The shaft 20 may be rotated by any appropriate means (not shown) to rotatably carry the applicator roller 18 therewith. The housing 16 will store therein a quantity of single component developer powder or toner herein collectively referred to as developer powder 22. A level sensor 23 will be received within the housing 16 to determine the presence or amount of development powder stored therein.

Figure 2:
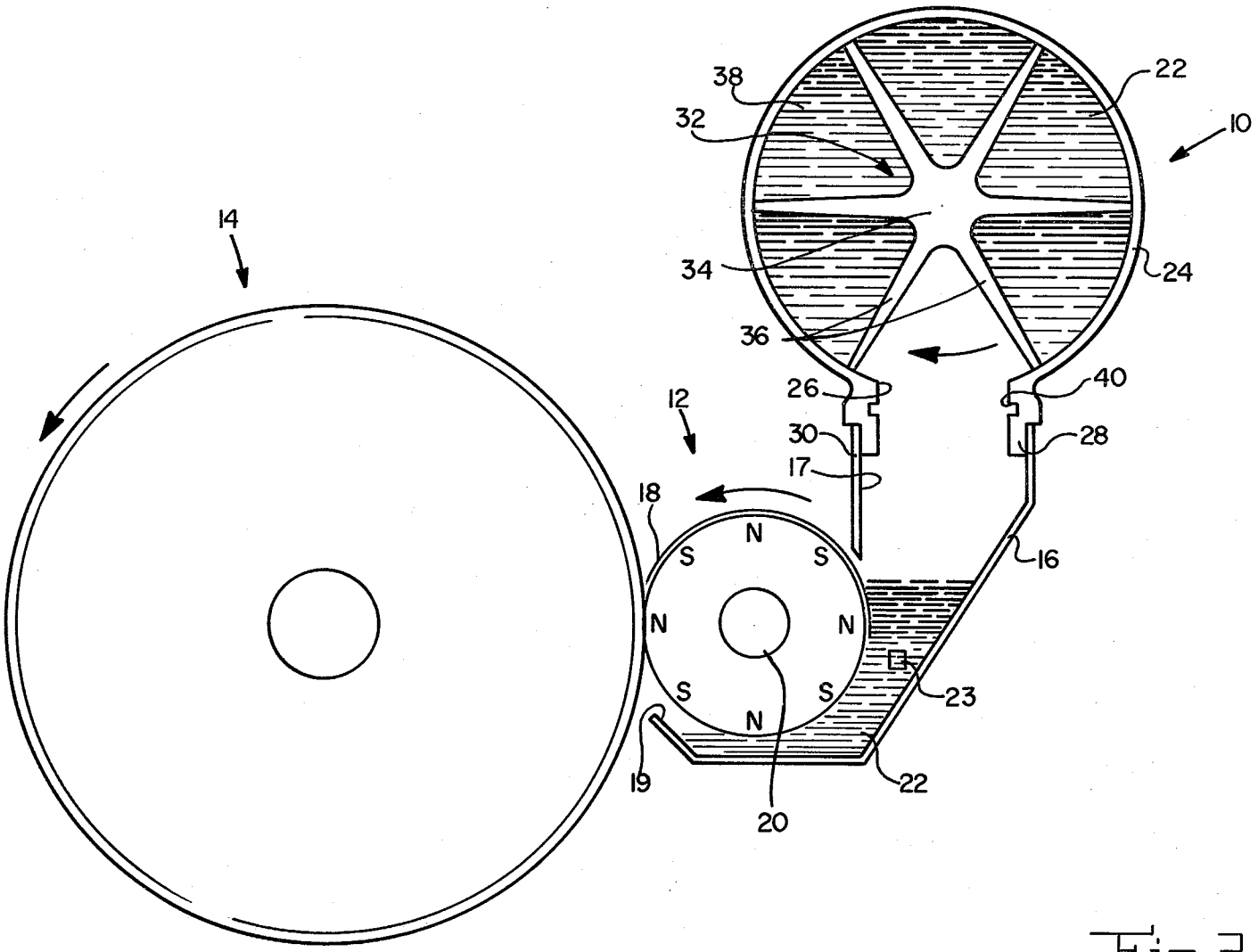
FIG. 2 is a longitudinal cross-sectional view of the dispensing apparatus shown in FIG. 1 as used with a magnetic brush unit for the development of electrostatic images.

Mounted above the sump 16 and confluent therewith is the development powder dispensing apparatus 10 which has a generally cylindrical housing 24 with an opening 26 and having with a neck 28 that is received within the sump 16. The neck 28 has a shoulder 30 that engages the walls of the sump 16 to thereby provide support for the dispensing apparatus 10. Located within the cylindrical housing 24 is a spyder 32 having a central shaft 34 with arms 36 that extend therefrom to the inside perimeter of the cylindrical housing 24. The arms 36 in cooperation with the cylindrical housing 24 segregate the interior of the cylindrical housing into discrete chambers or storate compartments 38. Extending within the neck 28 are a pair of laterally extending, longitudinally opposed slots or channels 40 that slidably receive a plate 42 therein. The plate 42 has a handle 44 so that the plate may manually slid inside of the channels 44 to render the chamber 38 immediately above the housing 16 confluent with the magnetic brush unit 12. The cylindrical housing 24 has end covers 46, 47 at each end thereof. The shaft 34 extends through end cover 46 and is journalled to the inside part of the end cover 47. The shaft 34 has a lever 48 thereon so that the spyder 38 may be manually rotated. The end cover 46 also may have a plurality of windows 50 so that the operator may visually determine if each of the chambers 38 has development powder 22 therein. As illustrated in FIG. 2, the dispensing apparatus 10 has development powder within three of the chambers 38.

The sequence for replenishment of development powder to the magnetic brush unit 12 begins with a signal from the level sensor 23 that development powder replenishment is required. This level sensor 23 may be an electromechanical device or any other type of level sensing device, such devices being well known in the art and not forming a part of the invention hereof. When replenishment is required, the chambers 38 may be rotated to bring a different compartment into position to supply development powder to the sump 16. Transfer of the development powder from the dispensing apparatus 10 into the sump 16 is accomplished by a wiping motion generated by the arms 36 moving across the interior of the cylindrical housing 24. Rotation of the chambers 38 is accomplished by manually turning the lever 48. If desired, such replenishment may be accomplished automatically by electromechanical means.

It will be appreciated that by its principle of design, the development dispensing apparatus 10 affords a degree of environmental protection to the surrounding area because of the closed structure presented after the apparatus 10 is mounted on the sump 16.

The development powder dispensing apparatus 10 will be filled with development powder 22 originally by inverting the apparatus, pulling the slide 42 to expose the adjacent chamber 38, filling that chamber with powder and then rotating the lever 48 one increment to expose the next chamber. These filling and rotating steps will be repeated until all the chambers 38 are filled. At that point, the slide 42 will be pushed inwardly to enclose the apparatus 10. To provide development powder to the sump 16, the neck 28 will be inserted into the opening 17 and the powder will be supplied as previously described.

What is claimed is:

1. A development powder dispensing apparatus for supplying powder to the sump of a magnetic brush unit comprising: a generally longitudinal, cylindrical housing having an opening therein, a spider received within said housing, spider having arms that separate the housing into individual chambers in cooperation with the walls of said housing, each of said chambers being of substantially equal volume, means for rotating said spider, means for attaching said dispensing apparatus to the sump of the magnetic brush unit with said opening forming a confluent relationship with said sump when so attached, said housing forming a closed structure after being attached to said sump and means for determining the presence of development powder in said chambers.

2. The apparatus of claim 1 including means for selectively closing said opening.

3. A development powder dispensing apparatus for supplying powder to the sump of a magnetic brush unit comprising: a housing having an opening therein, means for attaching said housing to the sump in a confluent relationship, means forming a plurality of individual chambers of substantially equal volume within said housing, means for selectively moving said chambers past said opening, said housing forming a closed structure after being attached to said sump and means for determining the presence of development powder in said chambers.

4. The apparatus of claim 3 including means for selectively closing said opening.

* * * * *